US009328911B2

(12) United States Patent
Chen et al.

(10) Patent No.: US 9,328,911 B2
(45) Date of Patent: May 3, 2016

(54) LED LAMP WITH A HEAT DISSIPATION STRUCTURE CAPABLE OF OMNIDIRECTIONALLY EMITTING LIGHT

(71) Applicant: Lediamond Opto Corporation, New Taipei (TW)

(72) Inventors: Peng-Yu Chen, New Taipei (TW); Chung-Ting Tseng, New Taipei (TW); Hsuan-Hsien Lee, New Taipei (TW); Mu-Yin Lu, New Taipei (TW)

(73) Assignee: LEDIAMOND OPTO CORPORATION, New Taipei (TW)

( * ) Notice: Subject to any disclaimer, the term of this patent is extended or adjusted under 35 U.S.C. 154(b) by 79 days.

(21) Appl. No.: 14/167,596

(22) Filed: Jan. 29, 2014

(65) Prior Publication Data

US 2015/0062895 A1 Mar. 5, 2015

(30) Foreign Application Priority Data

Sep. 2, 2013 (TW) ..... 102131593 A

(51) Int. Cl.

| | |
|---|---|
| ***F21V 29/76*** | (2015.01) |
| ***F21K 99/00*** | (2016.01) |
| ***F21V 17/10*** | (2006.01) |
| *F21Y 101/02* | (2006.01) |

(52) U.S. Cl.

CPC . *F21V 29/76* (2015.01); *F21K 9/30* (2013.01); *F21V 17/104* (2013.01); *F21Y 2101/02* (2013.01)

(58) Field of Classification Search

CPC ..... F21V 29/74; F21V 29/76; F21V 29/773; F21V 29/777; F21V 17/104; F21Y 2101/02; F21K 9/30

USPC ..... 362/294, 373, 218

See application file for complete search history.

(56) References Cited

U.S. PATENT DOCUMENTS 6,639,360 B2 * 10/2003 Roberts ..... F21V 29/76 257/E23.087
7,128,442 B2 * 10/2006 Lee ..... B60Q 1/2607 362/278

(Continued)

FOREIGN PATENT DOCUMENTS

| | | | |
|---|---|---|---|
| CN | 2859200 | Y | 1/2007 |
| CN | 201093225 | Y | 7/2008 |
| CN | 201615358 | U | 10/2010 |

(Continued)

OTHER PUBLICATIONS

Office Action dated May 5, 2015 of the corresponding Taiwan patent application.

(Continued)

*Primary Examiner* — Robert May

(74) *Attorney, Agent, or Firm* — Chun-Ming Shih; HDLS IPR SERVICES

(57) ABSTRACT

A LED lamp includes an LED module and thermo-conductive members. The LED module has a transparent base, a plurality of LEDs mounted on the transparent base and a transparent film covering the LEDs. The transparent base has thermo-conductive sections and electro-conductive sections. The thermo-conductive members are attached on the thermo-conductive sections. Thereby, the invention can omnidirectionally emit light and has great effect of heat dissipation.

11 Claims, 9 Drawing Sheets

(56) References Cited

U.S. PATENT DOCUMENTS

| | | | | |
|---|---|---|---|---|
| 7,482,632 | B2 * | 1/2009 | Lu | F21K 9/00 257/88 |
| 7,701,055 | B2 * | 4/2010 | Wu | F21K 9/13 257/625 |

FOREIGN PATENT DOCUMENTS

| | | | |
|---|---|---|---|
| CN | 101975345 | A | 2/2011 |
| CN | 102109115 | B | 8/2012 |
| CN | 202708996 | U | 1/2013 |
| CN | 103000652 | A | 3/2013 |
| JP | 2011048924 | A | 3/2011 |
| TW | 201105898 | A | 2/2011 |

OTHER PUBLICATIONS

Office Action dated Jan. 20, 2016 of the corresponding China patent application.

* cited by examiner

LED LAMP WITH A HEAT DISSIPATION STRUCTURE CAPABLE OF OMNIDIRECTIONALLY EMITTING LIGHT

BACKGROUND OF THE INVENTION

1. Technical Field

The invention relates to LED lamps, particularly to an LED lamp with a heat dissipation structure.

2. Related Art

A light emitting diode (LED) possesses advantages of low power-consumption, long life, compact volume and quick response, so it has been extensively applied in various lamps. For example, LED bulbs and tubes have become primary lighting products.

However, LED lamps emit light only in a direction instead of multiple directions. This is a problem to be solved. Furthermore, an LED lamp usually uses a plurality of LED chips. This will generate considerable heat. Thus heat dissipation is another technical issue, too.

SUMMARY OF THE INVENTION

An object of the invention is to provide an LED lamp with a heat dissipation structure, which can omnidirectionally emit light and has great effect of heat dissipation.

To accomplish the objection, the LED lamp of the invention includes an LED module and thermo-conductive members. The LED module has a transparent base, a plurality of LEDs mounted on the transparent base and a transparent film covering the LEDs. The transparent base has thermo-conductive sections and electro-conductive sections. The thermo-conductive members are attached on the thermo-conductive sections.

Another object of the invention is to provide an LED lamp with a heat dissipation structure, whose thermo-conductive members are shaped into clamps fastening on two sides of the transparent base. Thus, the heat from the LED can be dissipated by the clamps.

Still another object of the invention is to provide an LED lamp with a heat dissipation structure, whose thermo-conductive members may include clamps and a fin module. The transparent base is fastened to the fin module by the clamps. Thus, the heat from the LED can be dissipated by the clamps and fin module.

Yet another object of the invention is to provide an LED lamp with a heat dissipation structure, whose thermo-conductive members can be made of metal, glass fiber or other materials. The transparent base is attached on the thermo-conductive members to transfer heat through the thermo-conductive members. Additionally, the LED lamp may be disposed with a thermo-conductive material (such as thermo-conductive gel or thermo-conductive silver) on the transparent base to enhance effect of heat transfer.

In comparison with the related art, the LED module of the LED lamp of the invention has a transparent base whose periphery includes thermo-conductive sections and electro-conductive sections. The thermo-conductive members are attached on the thermo-conductive sections. Thus, the light from the LED can be omnidirectionally emitted through the transparent base. An object of omnidirectionally lighting can be obtained. Furthermore, the heat from the LED can be dissipated by the thermo-conductive members, so the invention can accomplish a better effect of heat dissipation.

DETAILED DESCRIPTION OF THE INVENTION

Figure 1:
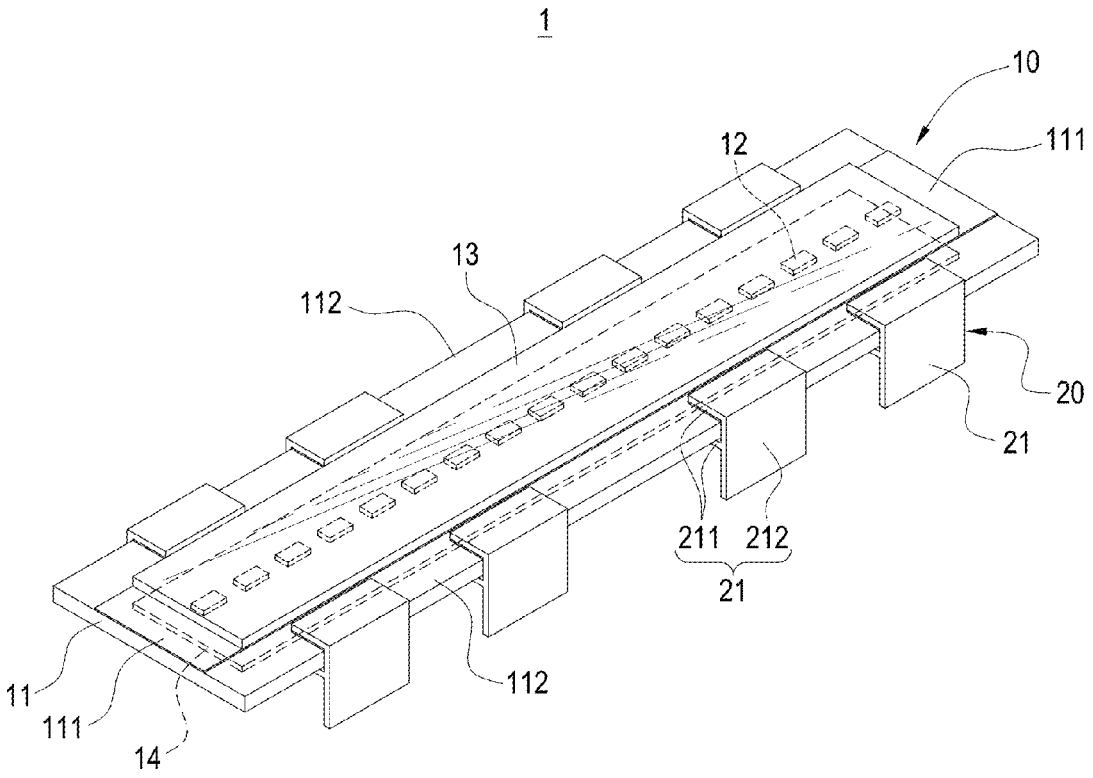
FIG. 1 is a perspective view of the invention.
Figure 2:
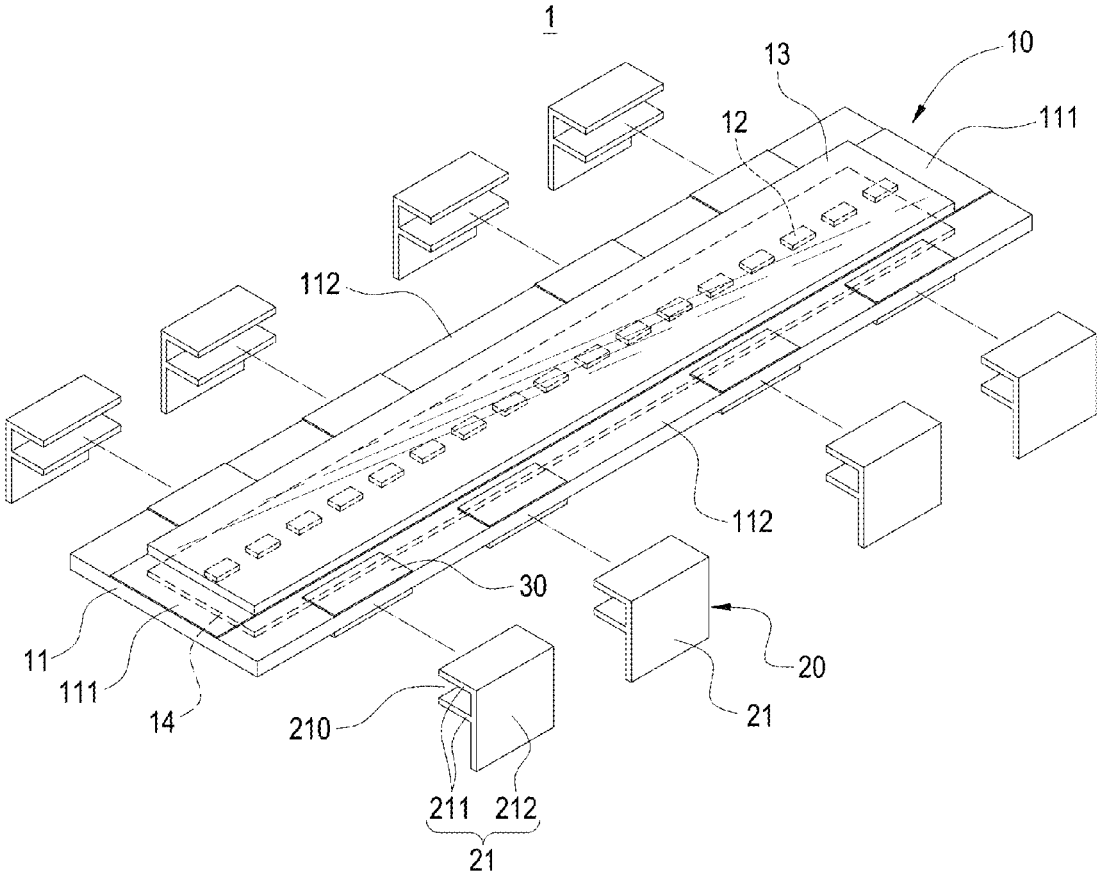
FIG. 2 is an exploded view of the invention.
Figure 3:
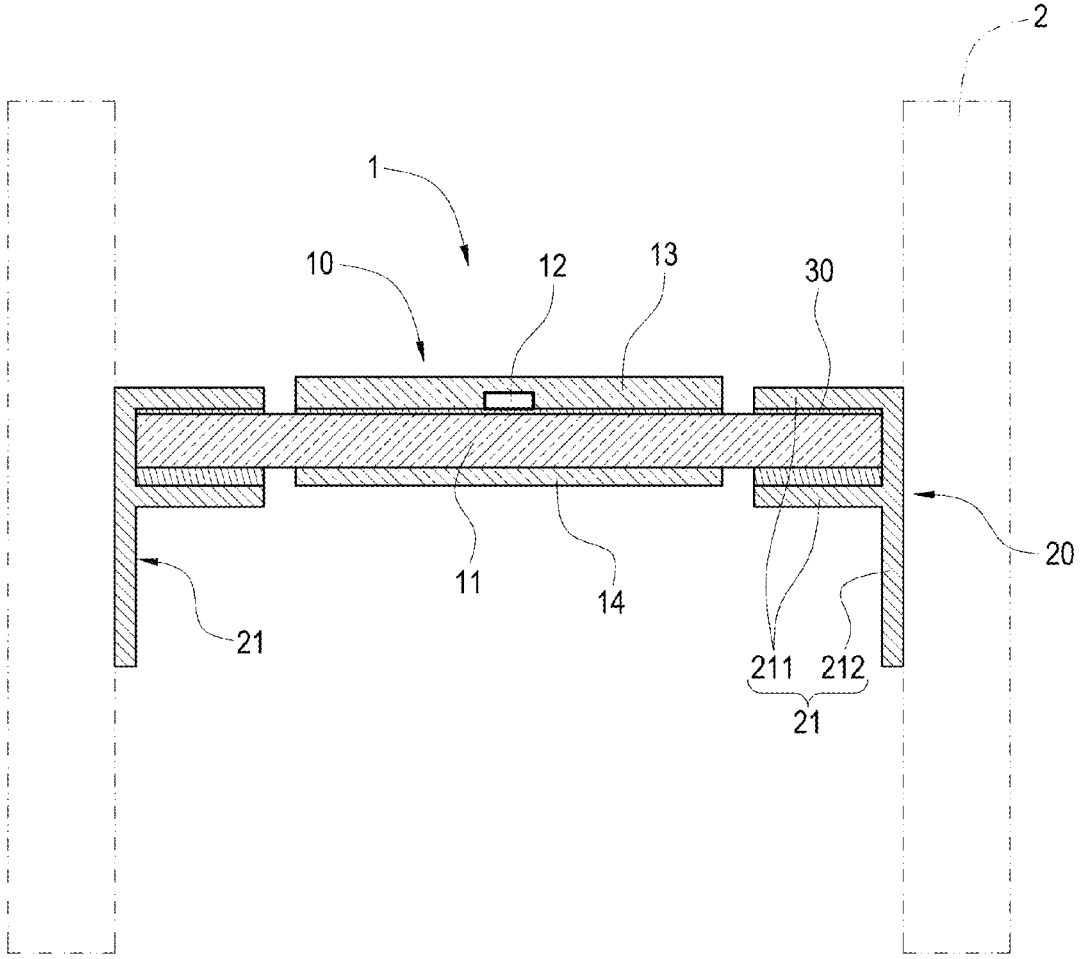
FIG. 3 is a sectional view of the invention.

Please refer to FIGS. 1-3. The LED lamp 1 of the invention includes an LED module 10 and thermo-conductive members 20. The thermo-conductive members 20 connect the LED module 10 for heat dissipation.

The LED module 10 has a transparent base 11, a plurality of LEDs 12 mounted on the transparent base 11 and a transparent film 13 covering the LEDs 12. The transparent base 11 has a circuit layer (not shown), thermo-conductive sections 112 and electro-conductive sections 111. The LEDs 12 are electrically connected to the circuit layer and are arranged at linearly regular intervals. Another transparent film 14 is attached on the other side of the transparent base 11 against the transparent film 13. When the light from the LEDs 12 rays toward this side, the transparent film 14 can homogenize the light.

The transparent films 13, 14 may further include fluorescent powder (not shown). The fluorescent powder is used to convert wavelength of the light from the LEDs 12. That is, the light can be mixed to convert into another color.

The thermo-conductive members 20 are made of metal with great thermal conductivity, such as aluminum or copper. The thermo-conductive members 20 are attached on the thermo-conductive sections 112.

The LED lamp 1 may further include thermo-conductive films 30 attached on the thermo-conductive sections 112. The thermo-conductive members 20 are separately attached on the thermo-conductive films 30. The thermo-conductive films 30 can increase effect of heat transfer between the thermo-conductive sections 112 (the transparent base 11) and the thermo-conductive members 20. The thermo-conductive films 30 are omissible, i.e, the thermo-conductive members 20 is in direct contact with the transparent base 11. The thermo-conductive members 20 clamp two sides of the transparent base 11 to enhance the effect of heat transfer between the transparent base 11 and the thermo-conductive members 20.

Each of the thermo-conductive members 20 includes clamps 21 separately fastening on one of the thermo-conductive sections 112. In detail, the clamp 21 includes a pair of clamping sheets 211 and an extension sheet 212 connecting the clamping sheets 211. The clamps 21 separately fasten on two sides of the transparent base 11 (the thermo-conductive sections 112). An insertion space 210 is formed between the clamping sheets 211 for receiving the transparent base 11. The extension sheet 212 is perpendicular to the transparent base 11 to dispose the surface of the LED 12. In other words, the clamp 21 is of an F-shape, but not limited to this shape.

As shown in FIG. 3, after the clamps fasten on the thermo-conductive sections 112 of the transparent base 11, the heat from the LEDs 12 can be transferred to the clamps 21 via the thermo-conductive sections 112. When the LED lamp 1 is connected with a heat sink 2, the heat in the clamps 21 can be further transferred to the heat sink 2 to speed up the effect of heat dissipation. It should be noted that the light emitted by the LEDs 12 can ray from two opposite sides of the transparent base 11 for omnidirectional lighting.

Figure 4:
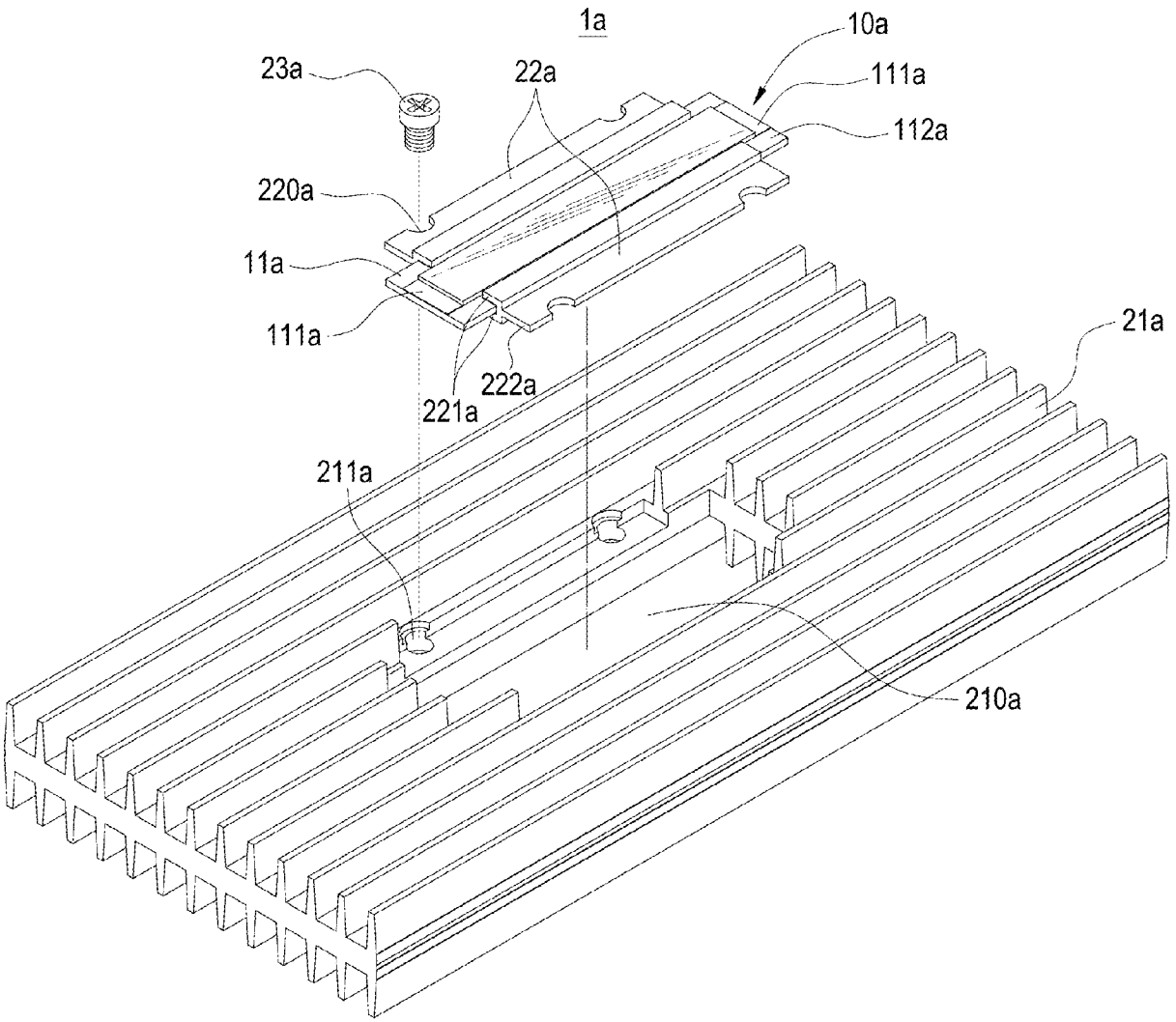
FIG. 4 is an exploded view of the second embodiment of the invention.
Figure 5:
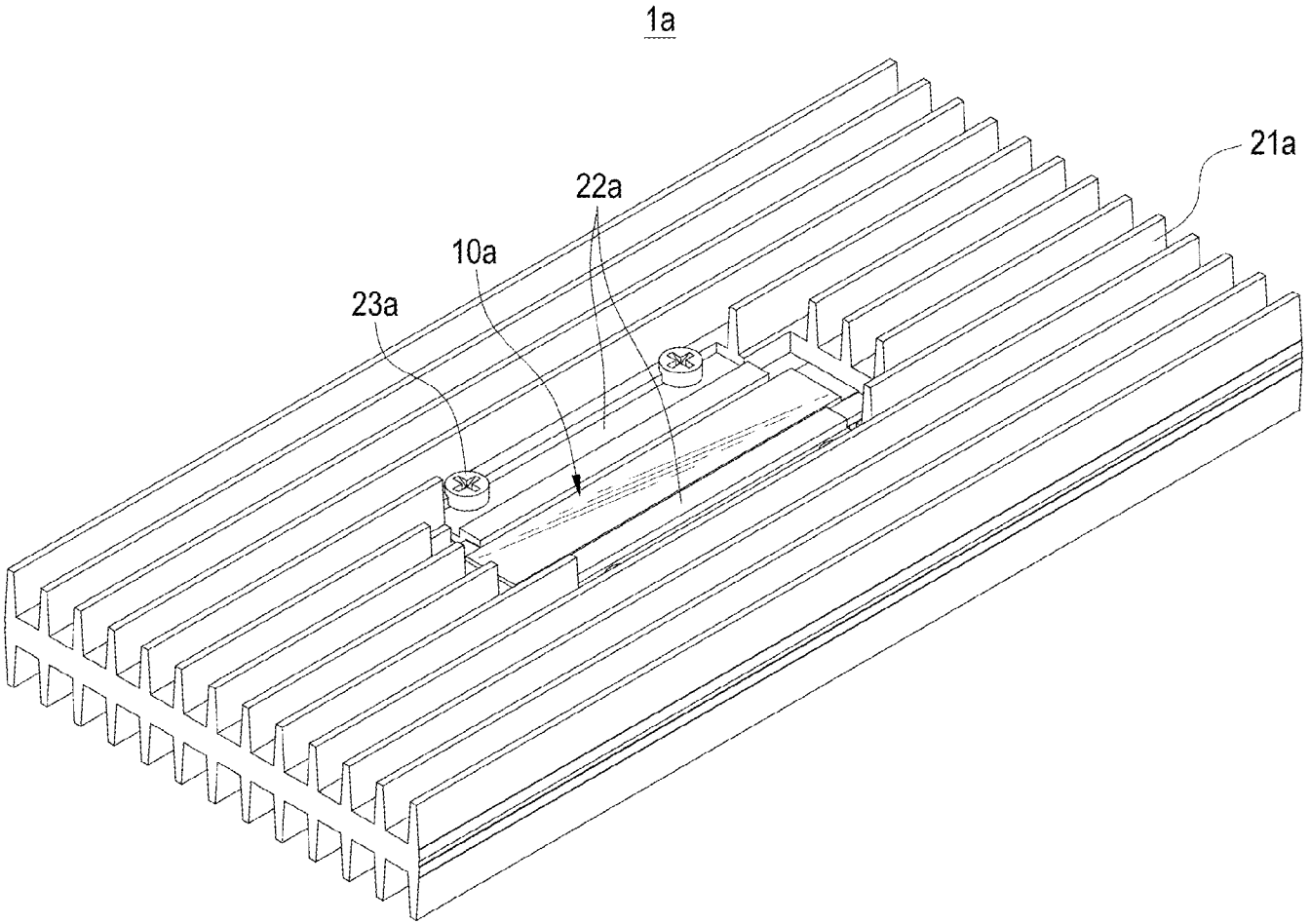
FIG. 5 is a perspective view of the second embodiment of the invention.
Figure 6:
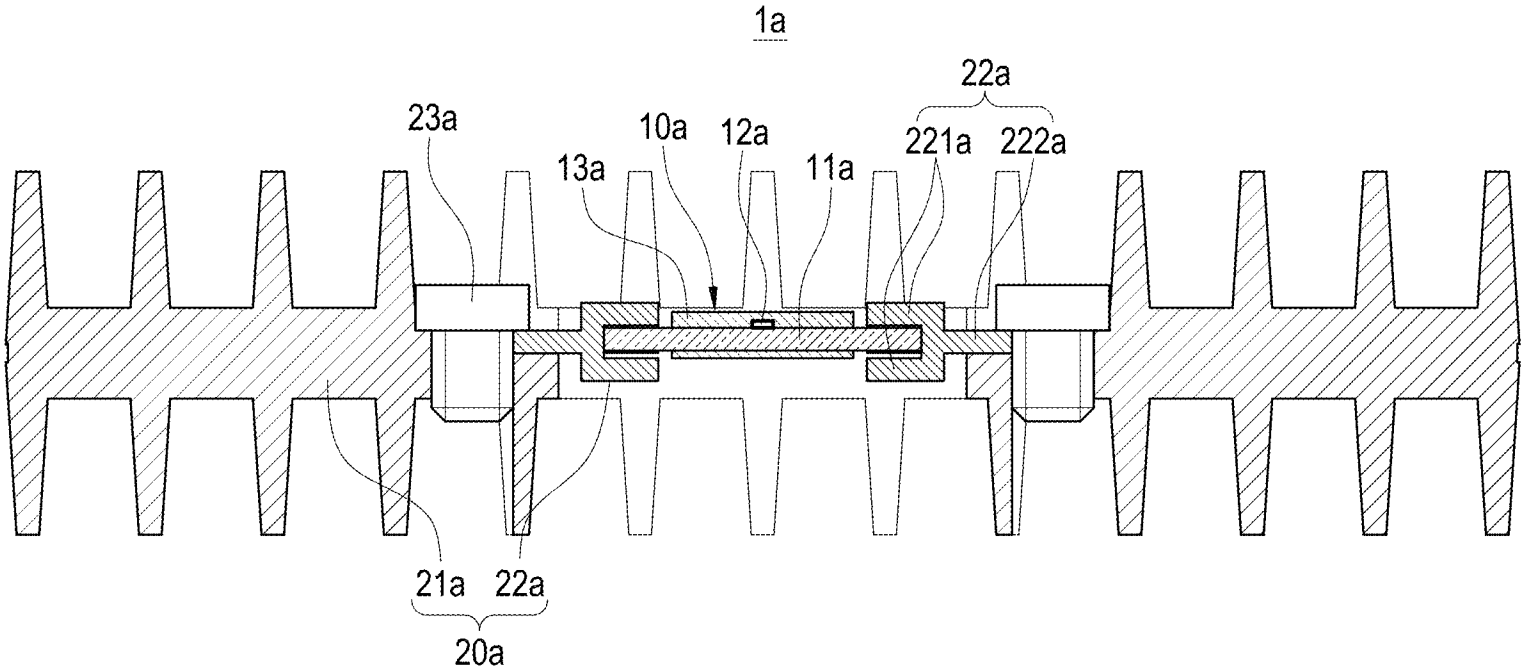
FIG. 6 is a sectional view of the second embodiment of the invention.

Please refer to FIGS. 4-6, which show the second embodiment of the invention. In this embodiment, the LED lamp 1*a* includes an LED module 10*a* and a thermo-conductive member 20*a*. The LED module 10*a* is the same as that of the first embodiment and has a transparent base 11*a*, a plurality of LEDs 12*a* mounted on the transparent base 11*a* and a transparent film 13*a* covering the LEDs 12. The transparent base 11*a* has thermo-conductive sections 112*a* and electro-conductive sections 111*a*. The difference between the two embodiments is the thermo-conductive member 20*a*.

The thermo-conductive member 20*a* includes a fin module 21*a* and clamps 22*a* connected to the fin module 21*a*. The clamps 22*a* are attached on the thermo-conductive sections 112*a* of the transparent base 11*a*. The fin module 21*a* is formed with an aperture 210*a* corresponding to the LED module 10*a*. The LED module 10*a* is secured in the aperture 210*a* by the clamps 22*a*. The light emitted by the LED module 10*a* can be rayed from the aperture 210*a*.

The clamp 22*a* includes a pair of clamping sheets 221*a* clamping the transparent base 11*a* and an extension sheet 222*a* connecting the clamping sheets 221*a*. The extension sheet 222*a* is parallel to the transparent base 11*a* to dispose the surface of the LEDs 12*a*. A section of the clamp 22*a* is of a Y-shape. Two sides of the transparent base 11*a* are clamped between the clamping sheets 221*a*. The extension sheet 222*a* is formed with open holes 220*a*. The fin module 21*a* is formed with connecting holes 211*a*. The LED module 10*a* is fixed in the fin module 21*a* by separately securing fasteners 23*a* in the open holes 220*a* and the connecting holes 211*a*.

As shown in the FIG. 6, the clamps 22*a* separately clamp the thermo-conductive sections 112*a* on two sides of the transparent base 11*a* first, and then the fasteners 23*a* are used to secure the LED module 10*a* on the fin module 21*a*. The light emitted by the LEDs 12*a* can ray from two opposite sides of the transparent base 11*a* for omnidirectional lighting. Additionally, the heat from the LEDs 12*a* will be transferred to the clamps 22*a* and then to the fin module 21*a*. Finally, the heat will be dissipated by the fin module 21*a*.

Figure 7:
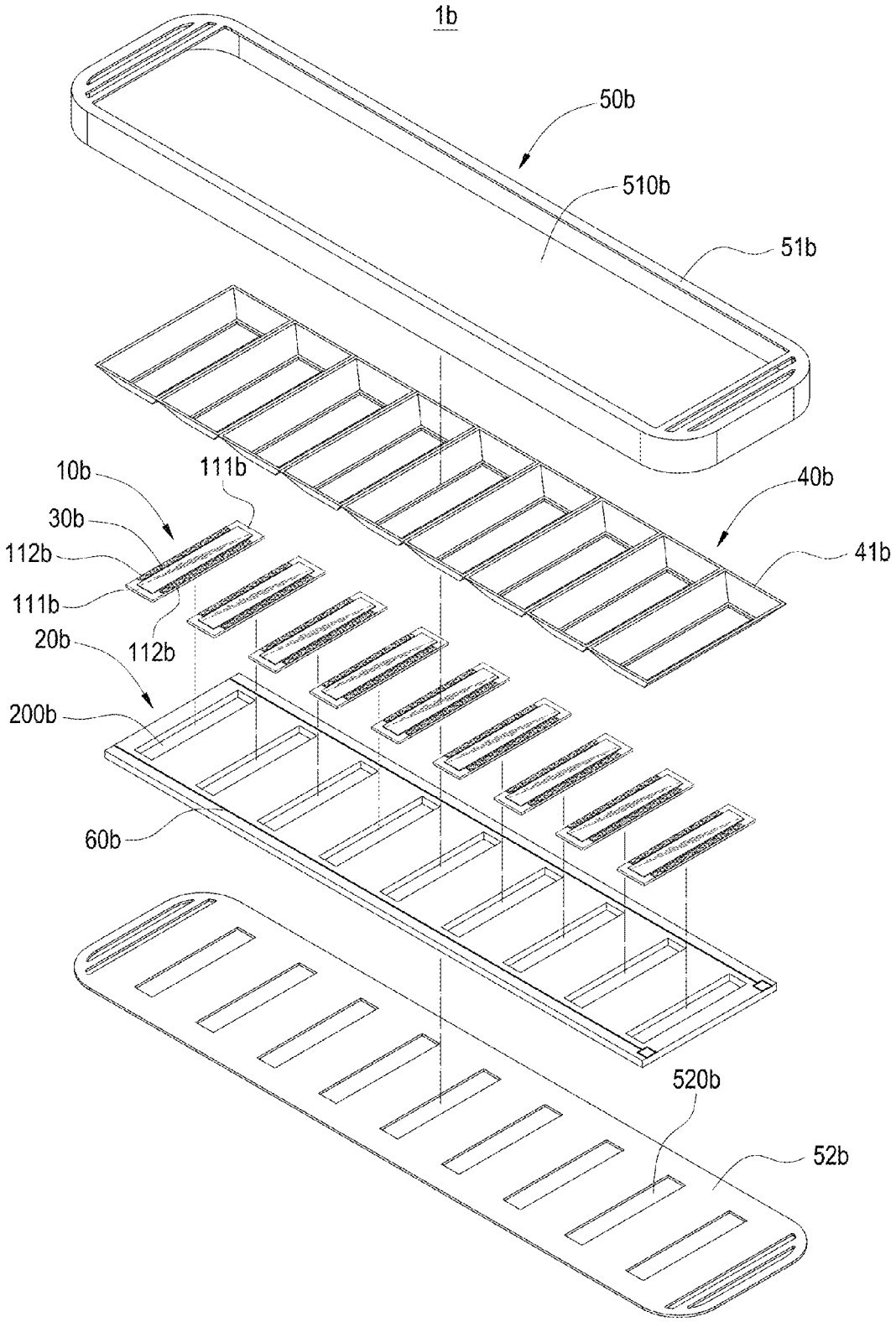
FIG. 7 is an exploded view of the third embodiment of the invention.
Figure 8:
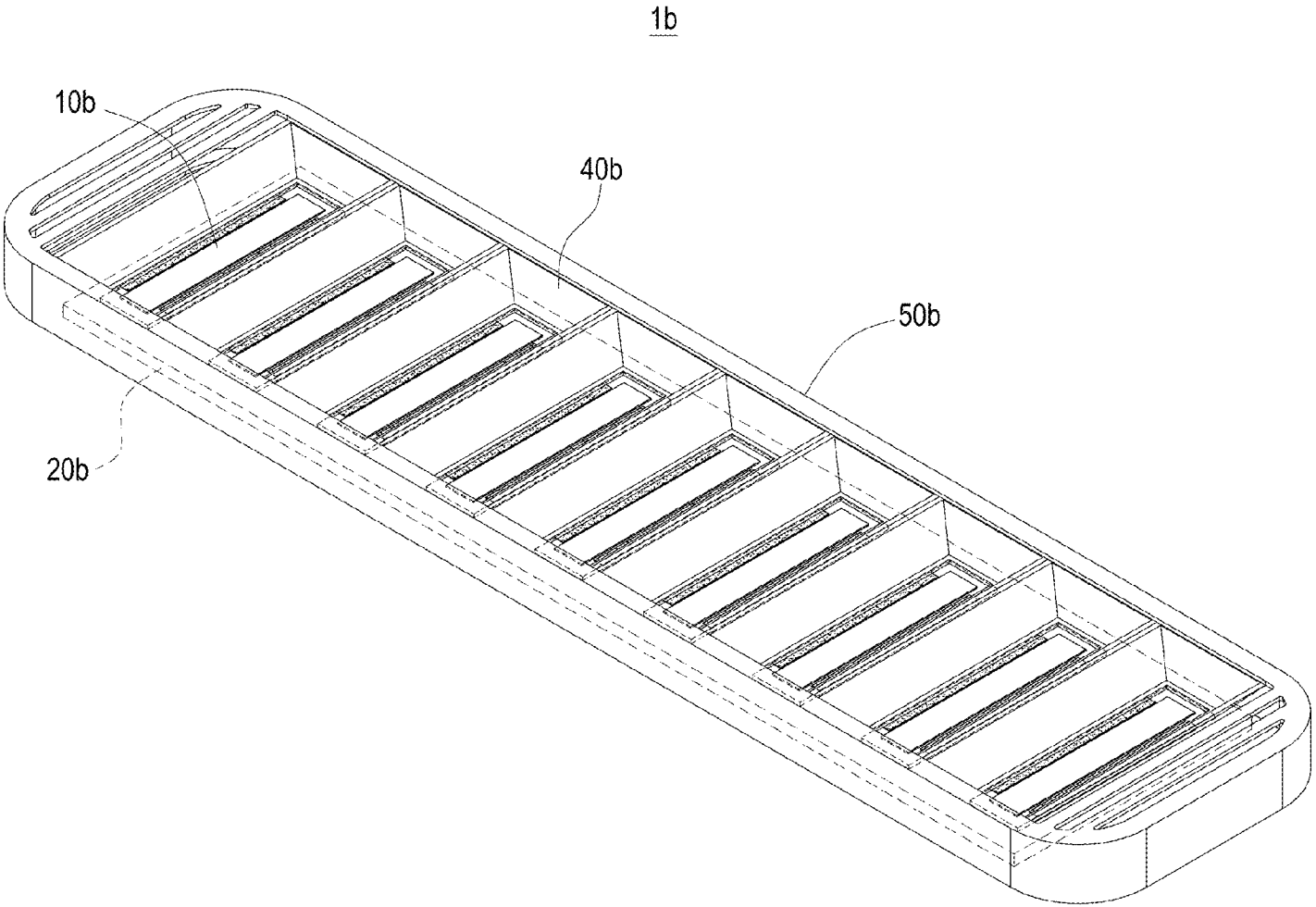
FIG. 8 is a perspective view of the third embodiment of the invention.
Figure 9:
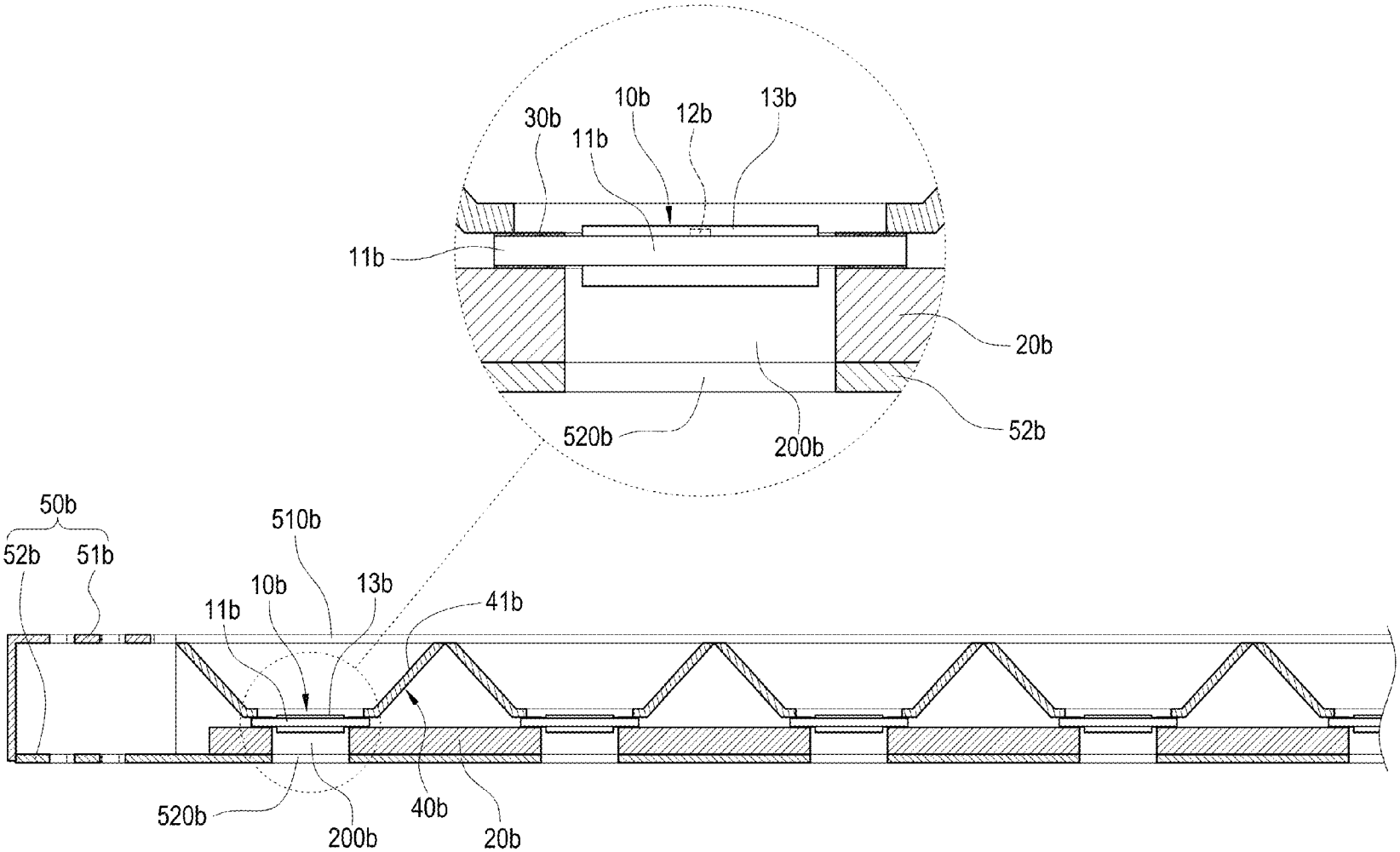
FIG. 9 is a sectional view of the fourth embodiment of the invention.

Please refer to FIGS. 7-9, which show the third embodiment of the invention. In this embodiment, the LED lamp 1*b* includes an LED module 10*b* and a thermo-conductive member 20*b*. The LED module 10*b* has a transparent base 11*b*, a plurality of LEDs 12*b* mounted on the transparent base 11*b* and a transparent film 13*b* covering the LEDs 12*b*. The transparent base 11*b* has thermo-conductive sections 112*b* and electro-conductive sections 111*b*.

The difference between the first and third embodiments is the thermo-conductive member 20*b*. In this embodiment, the thermo-conductive member 20*b* is made of metal, glass fiber (FR4) or other materials. The thermo-conductive member 20*b* is provided with an opening 200*b*. The transparent base 11*b* is fixed on the thermo-conductive member 20*b* and the thermo-conductive sections 112*b* are beside the opening 200*b*.

Furthermore, the LED lamp 1*b* includes a thermo-conductive silver layer 30*b* which is formed on two sides of the transparent base 11*b* for enhancing effect of heat transfer. The thermo-conductive member 20*b* is attached on the thermo-conductive silver layer 30*b* for enhancing effect of heat transfer between the thermo-conductive member 20*b* and the transparent base 11*b*.

The LED lamp 1*b* further includes a reflector 40*b* and a seat 50*b*. The reflector 40*b* surrounds the LED module 10*b*. The reflector 40*b* not only reflects the light from the LED module 10*b*, but also dissipates the heat from the LED module 10*b*. The heat from the LEDs 12*b* may also be transferred to the reflector 40*b* and then dissipated through the reflector 40*b*. That is, the reflector 40*b* also has an effect of heat dissipation. The seat 50*b* covers the reflector 40*b* and the thermo-conductive member 20*b*. The seat 50*b* includes an outer cover 51*b* and a bottom cover 52*b* connected thereto. The outer cover 51*b* is formed with a hollow 510*b* corresponding to the reflector 510*b*. The bottom cover 52*b* is formed with a slot 520*b* corresponding to the LED module 10*b*.

Preferably, the LED module 10*b* may be multiple in number and the opening 200*b* of the thermo-conductive member 20*b* is multiple for match. The openings 200*b* may be arranged in parallel or in matrix. Additionally, the thermo-conductive member 20*b* is provided with wires 60*b* which electrically connect to the electro-conductive sections 111*b* of the transparent base 11*b*. The reflector 40*b* includes reflective cups 41*b* corresponding to the LED modules 10*b*, for example, in an arrangement of straight line or array. Also, the slot 520*b* of the bottom cover 52*b* is multiple for corresponding to the LED modules 10*b*.

The description is that the light from the LED 12*b* will emit from two sides of the transparent base 11*b* to achieve the object of omnidirectionally lighting. Additionally, the LED modules 10*b* may be connected in series or parallel to provide required lighting. The wires are used to electrically connect the LED modules 10*b* in series or parallel.

While the forgoing is directed to preferred embodiments of the present invention, other and further embodiments of the invention may be devised without departing from the basic scope thereof. As such, the appropriate scope of the invention is to be determined according to the claims.

What is claimed is:

1. A light emitting diode (LED) lamp with a heat dissipation structure, comprising:

an LED module, having a transparent base, a plurality of LEDs mounted on the transparent base and a transparent film covering the LEDs, wherein the transparent base comprises thermo-conductive sections and electro-conductive sections; and a plurality of thermo-conductive members, attached on the thermo-conductive sections, wherein each thermo-conductive member comprises a fin module and clamps connected to the fin module, and the clamps are attached on the thermo-conductive sections of the transparent base;

wherein the clamp comprises a pair of clamping sheets and an extension sheet connecting the clamping sheets that clamp onto the transparent base, and the transparent base is clamped between the clamping sheets;

wherein the extension sheet is formed with open holes, the fin module is formed with connecting holes, and the LED module is fixed in the fin module by separately securing fasteners in the open holes and the connecting holes.

2. The LED lamp of claim 1, further comprising thermo-conductive films attached on the thermo-conductive sections, wherein the thermo-conductive members are separately attached on the thermo-conductive films.

3. The LED lamp of claim 1, wherein the fin module is formed with an aperture corresponding to the LED module, and the LED module is secured in the aperture by the clamps.

4. The LED lamp of claim 1, wherein the extension sheet is parallel to the transparent base to dispose a surface of the LEDs.

5. The LED lamp of claim 1, further comprising a thermo-conductive silver layer which is formed on the thermo-conductive sections, and the thermo-conductive member is attached on the thermo-conductive silver layer.

6. The LED lamp of claim 1, wherein the thermo-conductive member is made of metal or glass fiber, the thermo-conductive member is provided with an opening, and the transparent base is fixed on the thermo-conductive member and the thermo-conductive sections are beside the opening.

7. The LED lamp of claim 6, wherein the LED module is multiple in number, and the opening corresponds to the LED modules in number and position.

8. The LED lamp of claim 7, the thermo-conductive member is provided with wires which electrically connect to the electro-conductive sections.

9. The LED lamp of claim 1, further comprising a reflector and a seat, the reflector surrounds the LED module, and the seat covers the reflector and the thermo-conductive member.

10. The LED lamp of claim 9, wherein the reflector comprises reflective cups corresponding to the LED modules in arrangement.

11. The LED lamp of claim 9, wherein the seat comprises an outer cover and a bottom cover connected thereto, the outer cover is formed with a hollow corresponding to the reflector, and the bottom cover is formed with a slot corresponding to the LED module.

* * * * *